US006331149B1

(12) United States Patent
Mikame et al.

(10) Patent No.: US 6,331,149 B1
(45) **Date of Patent: *Dec. 18, 2001**

(54) WOOD CLUB HEAD

(75) Inventors: Daisuke Mikame; Wataru Ban; Hideo Matsunaga, all of Saitama (JP)

(73) Assignee: Bridgestone Sports Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/388,527

(22) Filed: Sep. 2, 1999

(30) Foreign Application Priority Data

Oct. 15, 1998 (JP) ..... 10-294045

(51) Int. Cl.[7] ..... A63B 53/04
(52) U.S. Cl. ..... 473/330; 473/345

(58) Field of Search ..... 473/287, 289, 473/290, 324, 345, 346, 349, 327, 330, 331

(56) References Cited

U.S. PATENT DOCUMENTS 4,725,062 * 2/1988 Kinney .
5,346,217 * 9/1994 Tsuchiya .
5,485,998 * 1/1996 Kobayashi .
5,573,467 * 11/1996 Chou .
6,048,278 * 4/2000 Meyer .

* cited by examiner

*Primary Examiner*—Sebastiano Passaniti
(74) *Attorney, Agent, or Firm*—Sughrue, Mion, Zinn, Macpeak & Seas, PLLC

(57) ABSTRACT

A wood club head provided with a metal shell and having a head volume of 200 cc or more, wherein the ratio (H/W) of a maximum height (H) of a face (2) acting as a hitting surface to a maximum width (W) of the face is set to be in a range of $0.65 \leqq (H/W) \leqq 1.0$, and the area of the face is set to be not smaller than 20 $cm^2$.

4 Claims, 2 Drawing Sheets

WOOD CLUB HEAD

BACKGROUND OF THE INVENTION

1. Field of the Invention

The present invention relates to the shape of a face of a wood-type golf club head.

2. Description of the Related Art

In order to understand how to increase of a distance or carry the ball hit by a club, the structure and the material of a wood club head have been investigated. In the background art, particularly, with respect to a face acting as a hitting surface, the hardness of the material has been actively increased so as to increase the repulsion force. Since there is a limit in the weight of the head, however, the development of the material has reached an end (a limit) with titanium and an alloy thereof. At this point, however, it can be gathered that there is a movement of reconsideration of utilization of the repulsion force based on the flexure of the face at the time when a ball is hit.

Setting the thickness of a face to be extremely thin in order to increase the flexure of the face has become a limit substantially from a point of view of durability. Further, although there has been proposed such a method that a ring-like groove is formed in a face at its peripheral edge portion so that the flexure is increased by the transformation of the groove, there is generated a fear in the durability of the groove portion if it is intended to obtain sufficient repulsion force.

SUMMARY OF THE INVENTION

In order to eliminate the foregoing disadvantage, an object of the present invention is to provide a wood club head in which the repulsion force of a face is increased without sacrificing durability.

In order to achieve the above object, according to the present invention, there is provided a wood club head comprising a metal shell and a face acting as a hitting surface, the head having a head volume of 200 cc or more, wherein a ratio (H/W) of a maximum height (H) of the face to a maximum width (W) of the face is set to be in a range of $0.65 \leqq (H/W) \leqq 1.0$, and an area of the face is set to be not smaller than 20 $cm^2$.

DETAILED DESCRIPTION OF THE PREFERRED EMBODIMENTS

Preferred embodiments of the present invention will be described below with reference to the accompanied drawings.

Figure 1:
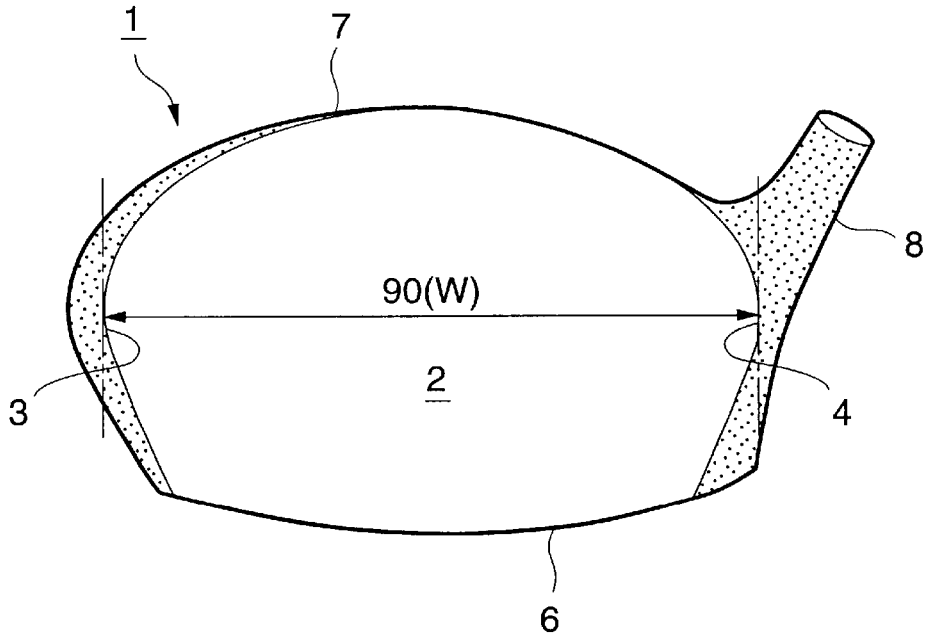
FIG. 1 is a front view showing a preferred embodiment of the present invention.
Figure 2:
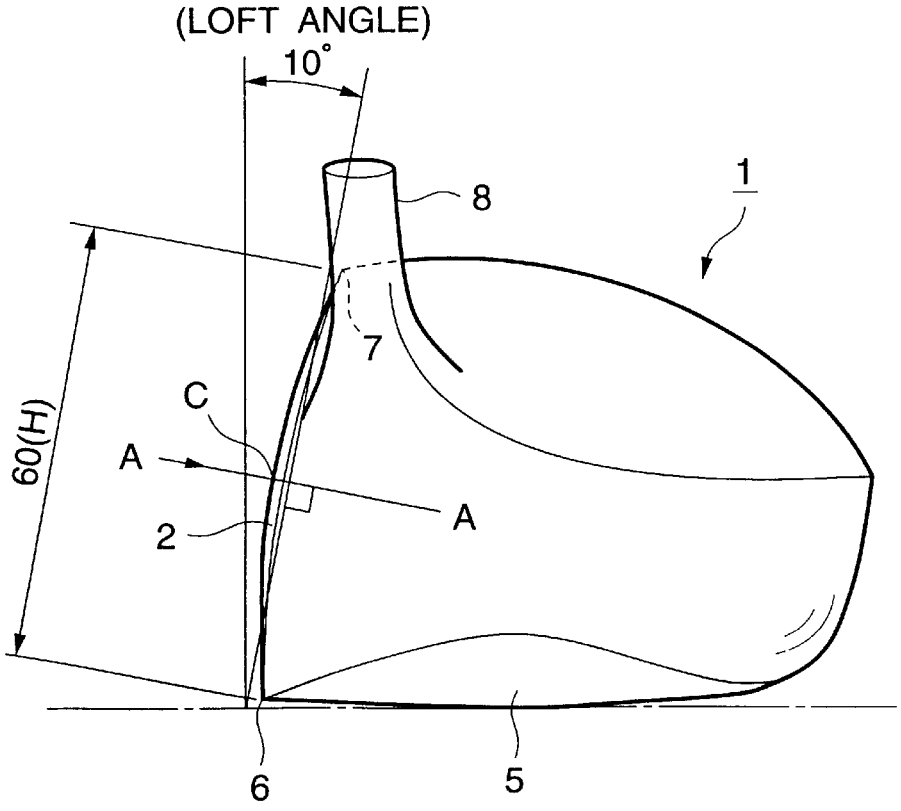
FIG. 2 is a side view of FIG. 1.

FIG. 1 is a front view showing an embodiment of a driver wood club (the loft angle is set to be 10°) and FIG. 2 is a side view showing a head 1 in addressing or setting up at normal lie and loft angles. The volume of the head 1 formed by casting and molding a titanium alloy is made to be about 300 cc and the weight of the head 1 is made to be 195 g.

In FIG. 2, when a face 2 is front-viewed (along an arrow in the drawing) from the direction of A—A perpendicular to the face 2 at a center C of the face 2, the maximum width (W) of the face 2 which is a maximum straight distance between a toe end 3 and a heel end 4 of the face 2 is set to be 90 mm, and the maximum height (H) of the face 2 measured as a straight distance from the lowermost end of a leading edge 6 which is a front edge of a sole 5 to the uppermost end of a top edge 7 is set to be 60 mm at a substantially central portion of the face 2. Further, in the drawing, the reference numeral 8 designates a hozel for fixing the shaft.

Therefore, in this embodiment, the ratio (H/W) is set to be 0.66. Further, the area of the face 2 is set to be about 42 $cm^2$, the thickness of the face 2 is set to be 2.8 mm all over the surface, and the material of the face 2 is a cast titanium alloy.

Figure 3:
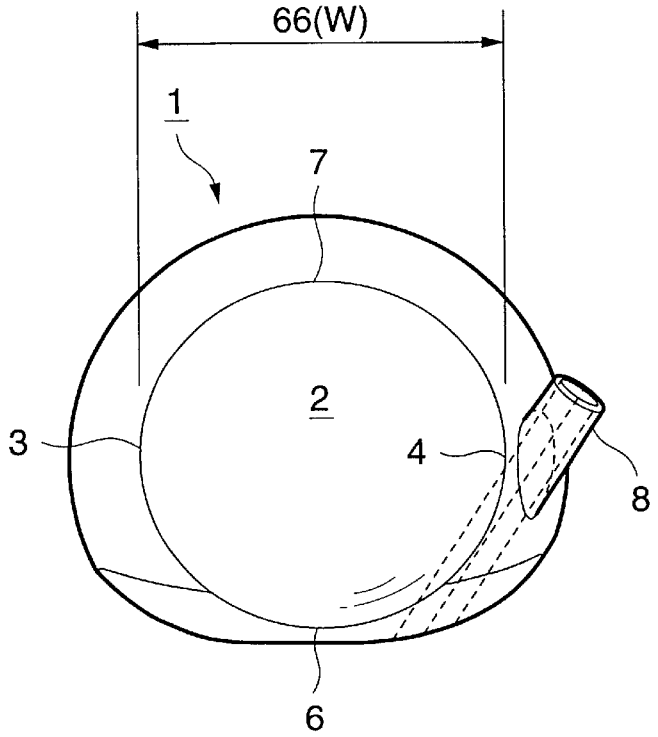
FIG. 3 is a front view showing another embodiment.
Figure 4:
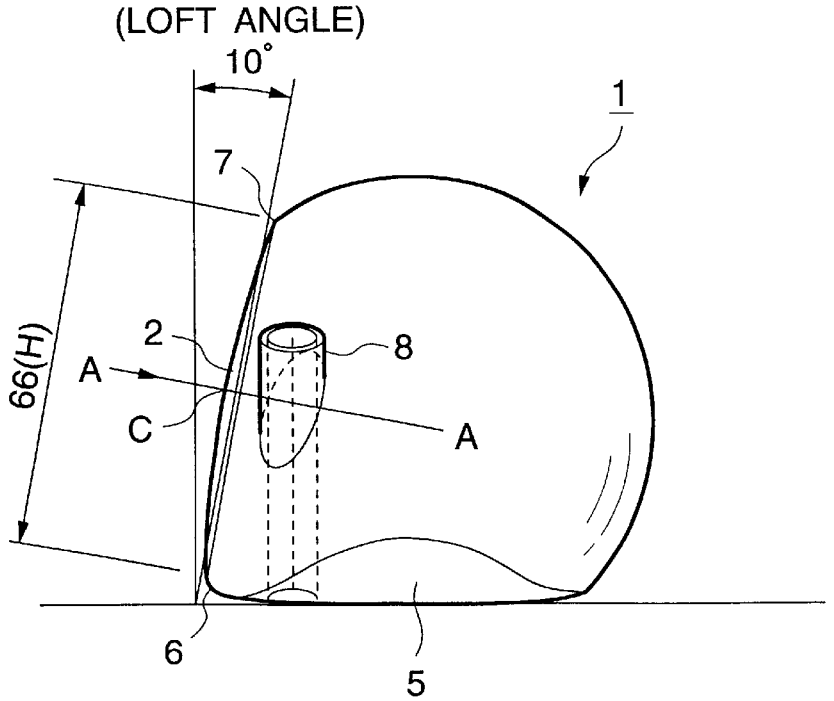
FIG. 4 is a side view of FIG. 3.

Next, referring to FIGS. 3 and 4, another embodiment will be described. FIGS. 3 and 4 are front and side views showing a state of a head in normal addressing or setting up respectively. Similarly to the foregoing embodiment, in this embodiment, there is used a driver wood in which a head 1 is made of a cast titanium alloy and a face is made of a forged titanium alloy and in which the volume and the weight of the head are set to be 270 cc and 190 g respectively. Similarly to the foregoing embodiment, when the face 2 is front-viewed (along an arrow in the drawing) from the direction (A—A) perpendicular to the face 2 at a center C of the face 2, the face 2 is formed into a substantially true circle.

Further, the maximum height (H) of the face 2 which is a straight distance from the lowermost end of a leading edge 6 (that is, the lowermost end of the face 2) to the uppermost end of a top edge 7 (that is, the uppermost end of the face 2) as well as the maximum width (W) of the face 2 which is a maximum straight distance between a toe end 3 and a heel end 4 are set to be 6.6 cm. Therefore, the ratio (H/W) is set to be 1.0. Moreover, the area of the face 2 is made to be 34.2 $cm^2$ and the thickness thereof is made to be 2.5 mm. Furthermore, in FIG. 4, the side surface of the head is formed into a helmet shape.

Preferably in the case of a driver wood, taking the repulsion force of the face 2, the head weight, the durability and the like, into consideration, the maximum width of the face 2 is set to be within a range of from 70 to 150 mm and the maximum height of the face 2 is set to be within a range of from 47 to 100 mm. Further, preferably, the area of the face 2 is set to be in a range of from 20 to 50 $cm^2$. As shown in this embodiment, according to the present invention, it is not necessary that the face 2 is made extremely thin or that any groove be formed in a part of the face 2 to concentrated stress, even when the flexure of the face 2 is increased. Consequently, the face 2 has excellent in durability.

Recently, as an experimental method of measuring the value of the repulsion force of the face 2, United States Golf Association (USGA) has proposed "a method in which a ball is made to hit, at a predetermined speed, a face of a club head mounted freely on a table, and the speed of the ball (that is, an initial speed of the ball) bounced off the face is measured". In this method, the repulsion force of the face is experimentally calculated as the restitution coefficient (e) by the following expression.

$$Vout/Vin=(eM-m)/(M+m)$$

wherein Vout is the speed of a ball bounced off from the face, that is, the initial speed of the ball (m/s); Vin is the speed of the ball when the ball is hit against the face (m/s); M is the weight (g) of the head; m is the weight (g) of the ball; and e is the restitution coefficient of the face.

The inventors have measured and analyzed the restitution coefficient e with respect to each of existing wood clubs having various shapes, on the basis of the foregoing expression by using an experimental machine equivalent to the "Ultra Ball Launcher" made by Wilson Co., which is made to be a reference by USGA. As a result, the inventors obtained such a knowledge that "the restitution coefficient e is more effectively increased by increasing the height of a face which is a distance between the leading and top edges of the face, particularly, by increasing the maximum height (H), rather than by increasing the width of the face which is a distance between the toe and heel ends of the face, particularly rather than by increasing the maximum width (W)". For example, if the maximum height of the face is increased by 4%, the restitution coefficient increases by 1.7 to 1.8%.

Further, the inventors obtained such a knowledge that "when the area of a face is not smaller than 20 $cm^2$, the restitution coefficient e more effectively increases as the area increases". The inventors concluded that, particularly in the case of a metal and shell-shaped head having a head volume of 230 cc or more and when the ratio (H/W) of the maximum height (H) of the face to the maximum width (W) of the same was set to be within a range of $0.65 \leqq (H/W) \leqq 1.0$ and the area of the face was set to be not smaller than 20 $cm^2$, the backward flexure of the face at the time of hitting became maximum so that the restitution coefficient increased.

Further, when the ratio (H/W) exceeds 1.0, there is a fear that vertical inertia moment around a horizontal line passing through the center of gravity of a head excessively increases so that the head is difficult to turn at the time of swinging and the increase of the head speed is suppressed. Moreover, a sense of incompatibility increases on the external appearance. If the ratio (H/W) is smaller than 0.65, on the contrary, the shapes of the head and face become approximated to those in the background-art so that the effects to be expected according to the present invention cannot be obtained. Incidentally, in an existing wood club head, the ratio (H/W) is mostly set to be in a range of from 0.4 to 0.5, that is, set to be smaller than 0.65.

If the area of the face 2 is smaller than 20 $cm^2$, the diameter of the face 2 becomes smaller than 50 mm in the case where the shape of the face 2 is substantially a circle, and the size of the face 2 becomes equal to or less than that of a ball (the diameter is about 43 mm) so that, unpreferably, the sense of difficulty of hitting a ball by the head increases at the time of hitting. Further, it is a matter of course that the flexure of the face 2 is reduced so that the repulsion force, that is, the spring force, of the face 2 decreases.

It is preferable to form the face 2 from a tough material and to make the thickness thereof thin. According to the present invention, the thickness (t) is set to be in a range of $2.0 \leqq t 3.5$ mm. If this value is smaller than 2.0 mm, the flexure of the face 2 excessively increases so that there is a significant fear in durability of the face 2. If this value exceeds 3.5 mm, on the contrary, the flexure is reduced so that the repulsion force becomes poor.

The height (H) and width (W) of the face 2 acting as a hitting surface are obtained in such a manner that the face 2 is front-viewed from the direction perpendicular to the face 2 at the center of the face 2 and the distance between predetermined positions is measured.

As described above, according to the present invention, the ratio (H/W) of the maximum height (H) of a face to the maximum width (W) thereof is set to be in a range of 0.65 to 1.0 and the area of the face is set to be not smaller than 20 $cm^2$. Therefore, it is possible to increase the repulsion force of the face without reducing the durability.

What is claimed is:

1. A wood club head comprising a hollow metal shell and a face acting as a hitting surface, said head having a volume of 200 cc or more, wherein a ratio (H/W) of a maximum height (H) of said surface to a maximum width (W) of said surface is set to be in a range of $<0.65$ $(H/W)<1.0$, an area of said face is set to be not smaller than 20 $cm^2$,and the maximum height of the face is set to be in a range of from 47 mm to 100 mm.

2. A wood club head according to claim 1, wherein a thickness of said face is set to be in a range of from 2.0 mm to 3.5 mm.

3. A wood club head according to claim 1, wherein the face is formed in substantially true circle.

4. A wood club head according to claim 2, wherein the face is formed in substantially true circle.

* * * * *